US006394372B2

(12) United States Patent
Rine et al.

(10) Patent No.: US 6,394,372 B2
(45) Date of Patent: May 28, 2002

(54) REFINING DISK

(75) Inventors: James C. Rine, 1016 Lake Montgomery Dr., Lake City, FL (US) 32025; John T. Byrne, 100 B Briameade Dr., Clinton, MS (US) 39056

(73) Assignees: James C. Rine, Lake City, FL (US); John T. Byrne, Clinton, MS (US)

( * ) Notice: Subject to any disclaimer, the term of this patent is extended or adjusted under 35 U.S.C. 154(b) by 0 days.

(21) Appl. No.: 09/484,452

(22) Filed: Jan. 18, 2000

Related U.S. Application Data

(60) Provisional application No. 60/116,492, filed on Jan. 20, 1999.

(51) Int. Cl.[7] ..... B02C 7/12

(52) U.S. Cl. ..... 241/28; 241/261.2; 241/296; 241/DIG. 31

(58) Field of Search ..... 241/28, 261.2, 241/261.3, 296, 297, 298, 300, DIG. 31

(56) References Cited

U.S. PATENT DOCUMENTS 4,166,584 A * 9/1979 Asplund ..... 241/298
4,423,845 A * 1/1984 Frazier et al. ..... 241/298
4,767,070 A * 8/1988 Nagao et al. ..... 241/261.2
4,966,651 A * 10/1990 Olson et al. ..... 241/28
5,238,194 A 8/1993 Rouse et al.
5,411,215 A 5/1995 Rouse
5,836,531 A * 11/1998 Maybon ..... 241/296
6,135,373 A * 10/2000 Davenport ..... 241/261.2

* cited by examiner

*Primary Examiner*—Mark Rosenbaum
(74) *Attorney, Agent, or Firm*—Heller Ehrman White and McAuliffe

(57) ABSTRACT

A refining disk is provided for use in various kinds of refining apparatus. The refining apparatus comprises juxtaposed disks with refining surfaces on the opposed faces, one disk rotating relatively to the other disk to work on the material therebetween. A typical refiner is disclosed in U.S. Pat. No. 3,049,307; however, the invention is applicable to various types of refiners including single rotating disk refiners and counter-rotating disk machines. Disks normally are cast which results in relatively soft low wear resistance that wear out and must be replaced regularly. The disks of this invention are constructed of the hardest wear resistant materials known including metal carbides.

14 Claims, 6 Drawing Sheets

REFINING DISK

This application claims benefit of U.S. provisional application Ser. No. 60/116,492 filed Jan. 20, 1999.

BACKGROUND AND SUMMARY OF THE INVENTION

The present invention relates to refining machines used to process materials such as rubber, wood, wood chips, cellulose, resins, plastics, vegetable material, food and feed products, and chemicals. More particularly, the present invention relates to refining disks used in refining machines.

According to the present invention, a refining disk is adapted for use with a refining machine to refine a material. The refining disk comprises a base portion adapted to be mounted to the refining machine and a refining portion coupled to the base portion and adapted to engage the material to refine the material. The base portion is made of a first substance, and the refining portion is made of a second substance that is harder than the first substance.

BRIEF DESCRIPTION OF THE DRAWINGS

The detailed description particularly refers to the accompanying figures in which:

FIG. 1 is a perspective view of a refining system having an upper refining disk mounted to a rotating material-feed inlet tube and a lower refining disk mounted to a stationary mounting member, the refining disks having a base portion and a particulate metal carbide refining portion coupled to the base portion, the refining system being configured to allow material to be fed through the inlet tube so that the material is processed (or cut) between the refining portions of the two refining disks;

FIG. 2 is a plan view of the refining system of FIG. 1 showing the lower refining disk being formed to include four grooves and the material being fed outwardly from a center of the disks through the grooves under centrifugal force;

FIG. 3 is a sectional view taken along line 3—3 of FIG. 2 showing the material entering the rotating inlet tube and being fed outwardly between the grooves and between the particulate metal carbide refining portions so that the material is refined by the refining disks as the material passes outwardly;

FIG. 4 is an enlarged view of a portion of FIG. 3 showing the material moving outwardly from a center of the disks so that the material passes between the two grooves of the two refining disks and between the particulate metal carbide refining portions of the two refining disks so that the material exiting from an outer perimeter of the refining disks is smaller than the material entering the refining system through the inlet tube;

FIG. 5 is an enlarged view of the particulate metal carbide refining portions of the refining disks of FIG. 4 showing each particulate metal carbide refining portion of each disk having a flat surface configured to abut the flat surface of the opposing disk, the refining portions defining cutting surfaces to cut the material as the material passes between the refining disks;

DETAILED DESCRIPTION OF THE DRAWINGS

Figure 1:
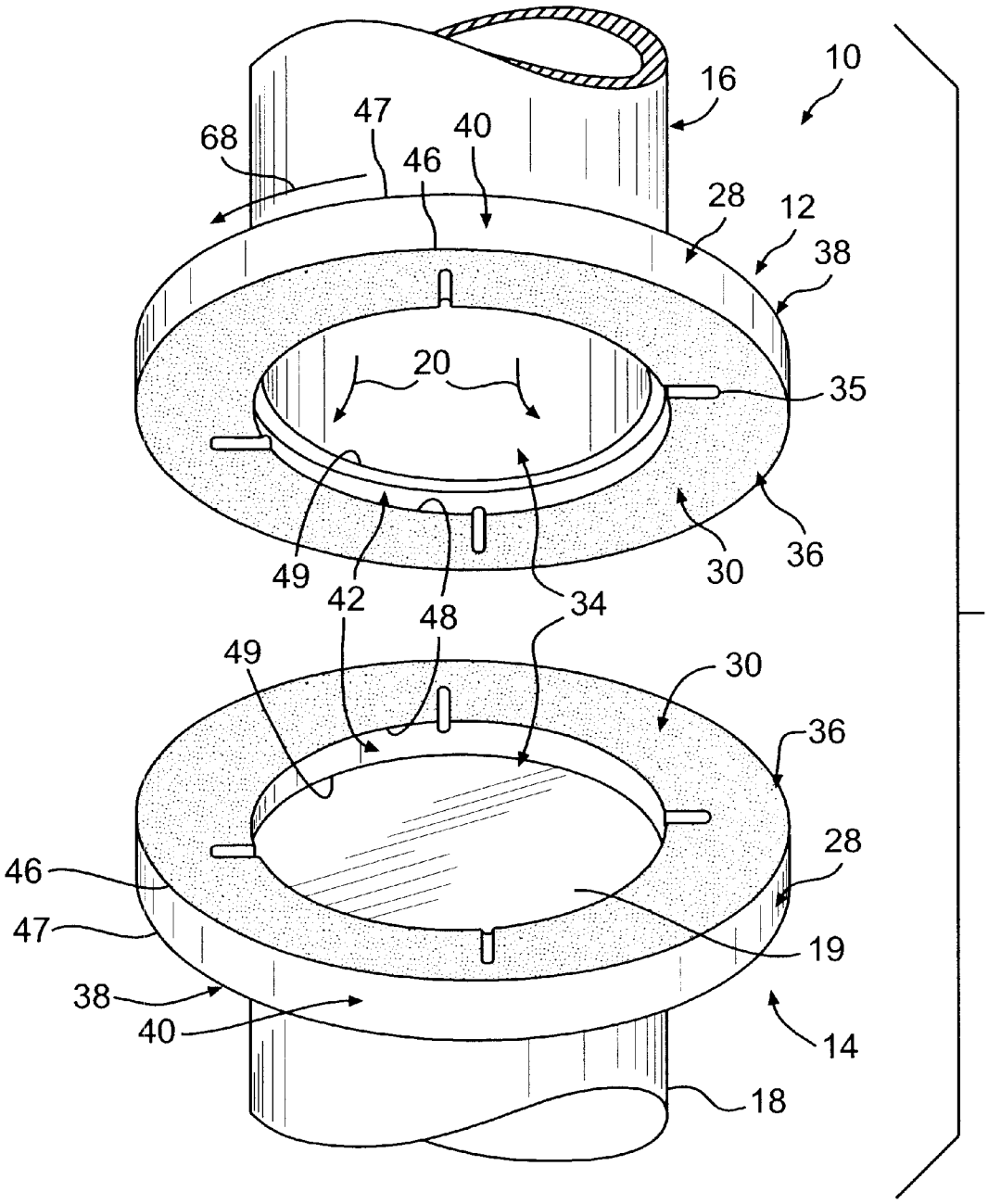
FIGS. 1–5 illustrate a vertical single-disk refining system where a first rotating disk rotates relative to a second stationary disk.

Referring now to the drawings, FIG. 1 illustrates a refining system 10 having first and second refining disks 12, 14 in accordance with the present invention. Refining system 10 is configured to allow refining disks 12, 14 to process (or refine) a material 20 such as rubber, wood, wood chips, cellulose, resins, plastics, vegetable material, food and feed products, and chemicals. Refining disks 12, 14 are held together under pressure and rotate relative to one another so that material 20 passing between refining disks 12, 14 is reduced in size as material 20 moves outwardly from a center of disks 12, 14 under centrifugal force.

As shown in FIG. 1, refining system 10 includes an inlet tube 16 mounted to upper refining disk 12 and a support member 18 mounted to lower refining disk 14. Inlet tube 16 is configured to allow material 20 to be fed through central opening 34 of upper refining disk 12. Inlet tube 16 is also configured to rotate so that upper refining disk 12 rotates in a direction indicated by arrow 68 relative to lower refining disk 14. Of course, inlet tube 16 can be configured to rotate in a direction opposite arrow 68 and/or refining disk 14 may be configured to rotate relative to refining disk 12, instead of vice versa as previously described.

Figure 2:
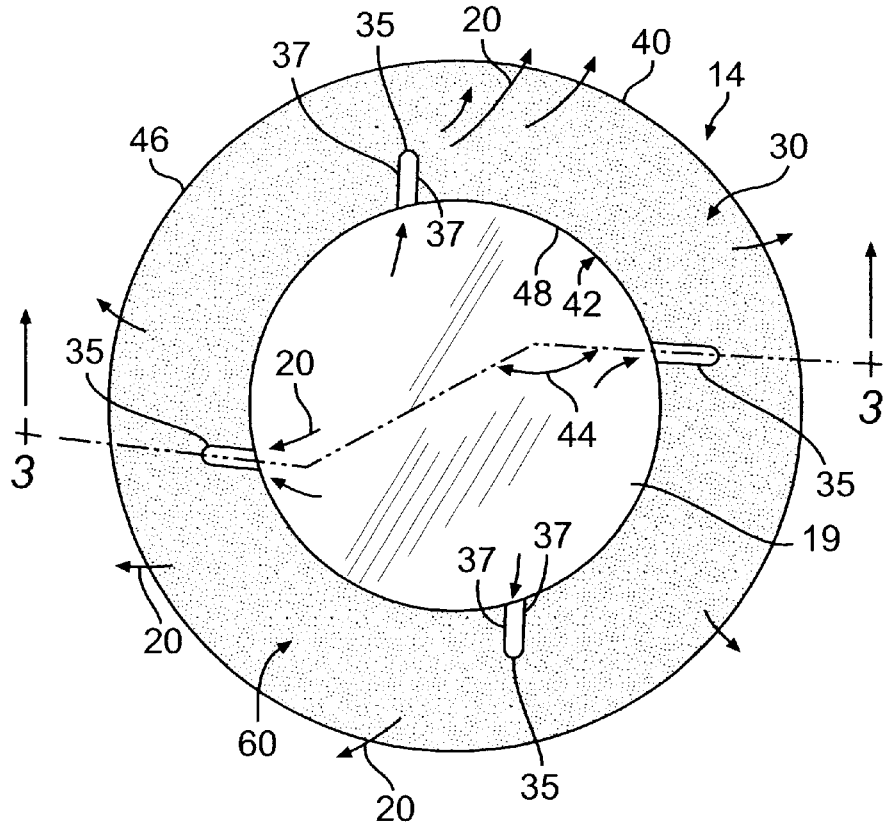

Support member 18 is configured to hold lower refining disk 14 in place relative to upper refining disk 12. Support member 18 preferably includes a top surface 19 that blocks material 20 from flowing through central opening 34 formed in lower refining disk 14. Thus, as material 20 is introduced through inlet tube 16, material 20 is forced to flow outwardly from a center of refining disks 12, 14 between upper and lower refining disks 12, 14 as shown in FIG. 2.

Figure 3:
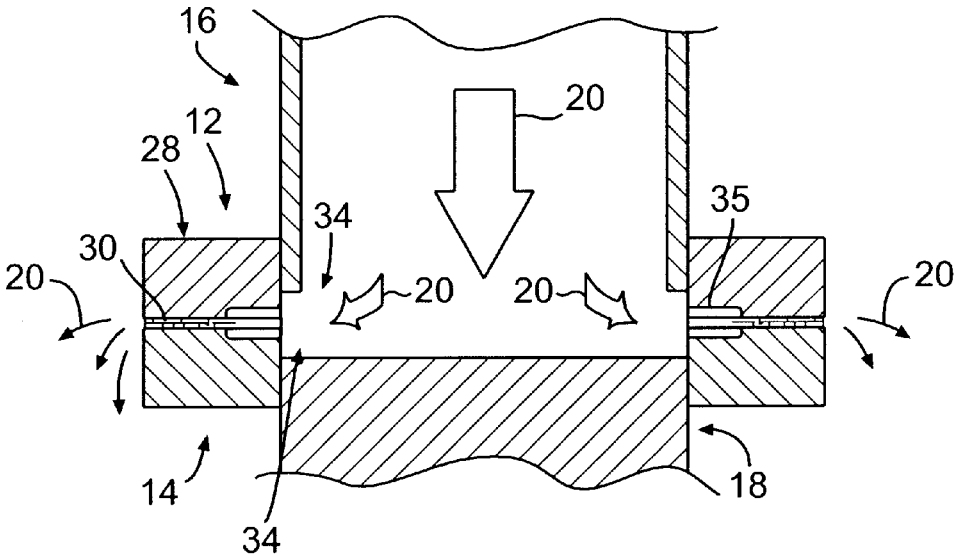
Figure 4:
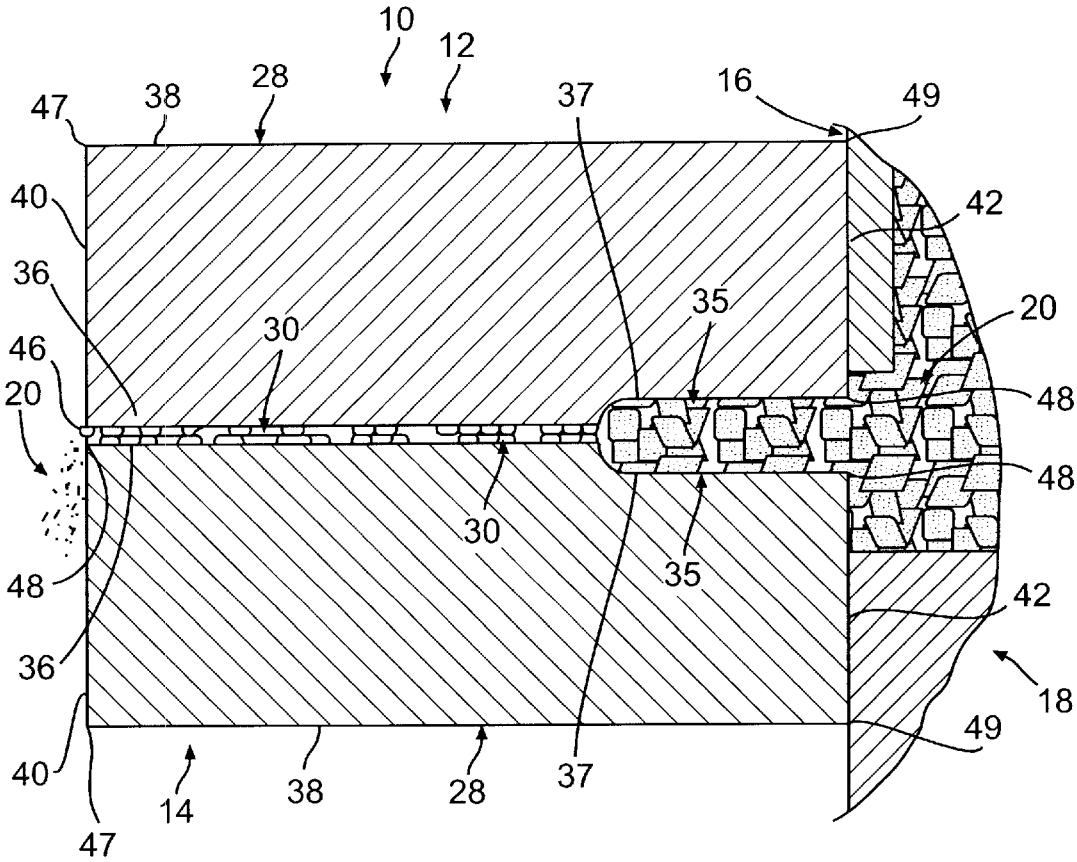

Refining disks 12, 14 cooperate to cut material 20 as material 20 moves outwardly between refining disks 12, 14, as shown in FIGS. 3–8. Each refining disk 12, 14 includes a base portion 28 and a refining portion 30 coupled to base portion 28, as shown in FIGS. 1–5. Base portion 28 is preferably made from a stainless steel material and is doughnut-shaped, as shown in FIG. 1. Base portion 28 defines central opening 34 through a center of each refining disk 12, 14. Base portion 28 includes a top surface 36, a bottom surface 38, an outer perimetal surface 40 extending between an outer perimetal edge 46, 47 of top and bottom surfaces 36, 38, respectively, and an inner surface 42 extending between an inner edge 48, 49 of top and bottom surfaces 36, 38, respectively. Inlet tube 16 and support member 18 are coupled to inner surfaces 42 of upper and lower refining disks 12, 14, respectively, as shown in FIGS. 3 and 4.

Base portion 28 is also formed to include a plurality of grooves 35 to enable material 20 to be fed between refining disks 12, 14. Grooves 35 are formed in top surface 36 of base portion 28 and extend from inner surface 42 toward outer surface 40. As shown in FIG. 2, base portion 28 is preferably formed to include four grooves 35 equally spaced apart and extending at an angle 44 from a center line of disk 12, 14. Grooves 35 preferably extend approximately half-way from inner surface 42 toward outer surface 40 and angle 44 is approximately 135 degrees. This configuration is preferable when a slurry rubber material is being processed at approximately 3600 rpm because cutting edges 37 of grooves 35 cut the rubber material to an appropriate size for introduction of the rubber material between the refining portions 30 of the refining disks 12, 14. However, the size, number, shape, and angle of grooves 35 can be adjusted as necessary when processing different materials and/or processing at different rotational speeds.

Refining portions 30 of each refining disk 12, 14 cooperate with grooves 35 to reduce the size of material 20 as material 20 moves outwardly between refining disks 12, 14, as shown in FIGS. 3–8. Refining portions 30 are defined by a hardened substance coupled to base portion 28, as shown best in FIGS. 1 and 5. The hardened substance can be any material that is sufficiently hard to resist wear while being capable of cutting (or grinding) material 20. For example, the hardened substance is preferably a particulate tungsten or silicon metal carbide that is welded to base portion 28. However, the hardened substance can be any metal carbide, diamond, ceramic, or other suitable substance whether particulate, segmented, stranded, or in some other form. The substance can also be welded, glued, fastened, bonded, or coupled in any other way to base portion 28.

Figure 5:
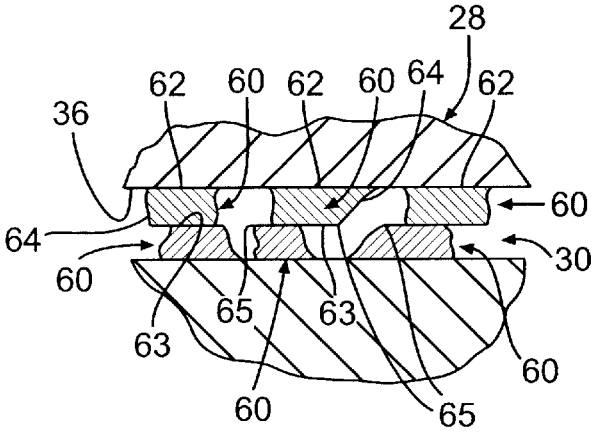

Each refining portion 30 is interrupted by a plurality of bumps 60 extending away from base portion 28 as shown in FIG. 5. Bumps 60 include a bottom surface 62 coupled to top surface 36 of base portion 28, a top surface 63 spaced apart from bottom surface 62, and a perimetal surface 64 extending between bottom surface 672 and top surface 63. Perimetal surfaces 64 mate with top surfaces 63 to define a cutting edge 65 on each of the bumps 60. Top surfaces 63 of each refining disk 12, 14 are preferably flat, as shown in FIG. 5, so that top surfaces 63 of each refining disk 12, 14 abut one another but top surfaces 63 may be configured in virtually any shape.

Figure 6:
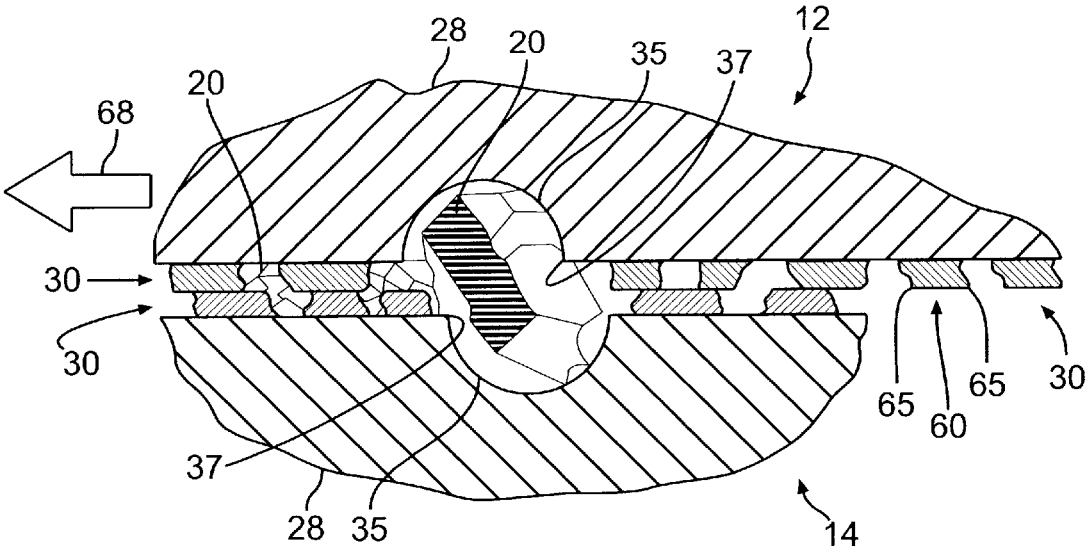
FIGS. 6–8 illustrate the material being cut by the refining disks as the upper disk rotates relative to the lower disk.
Figure 7:
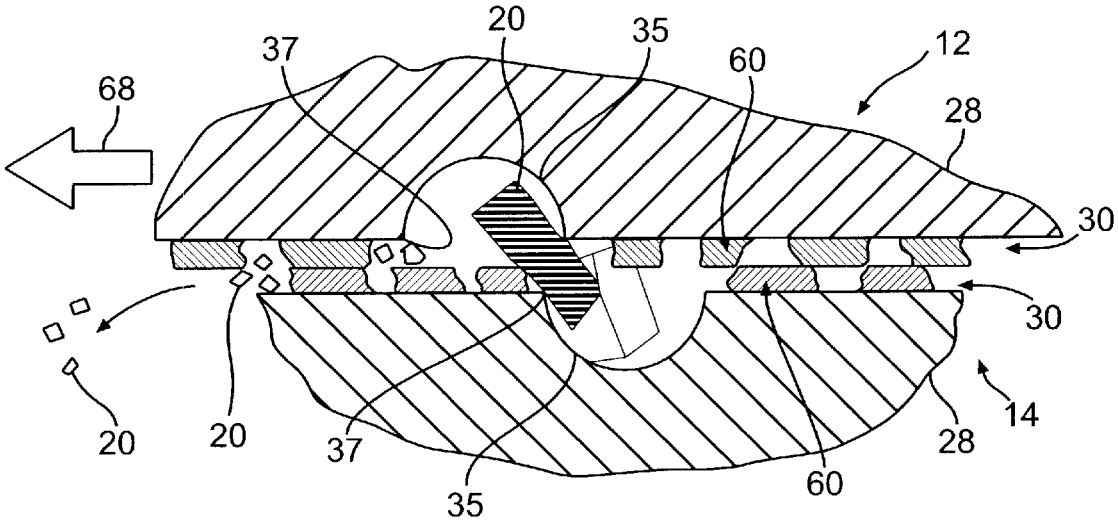
Figure 8:
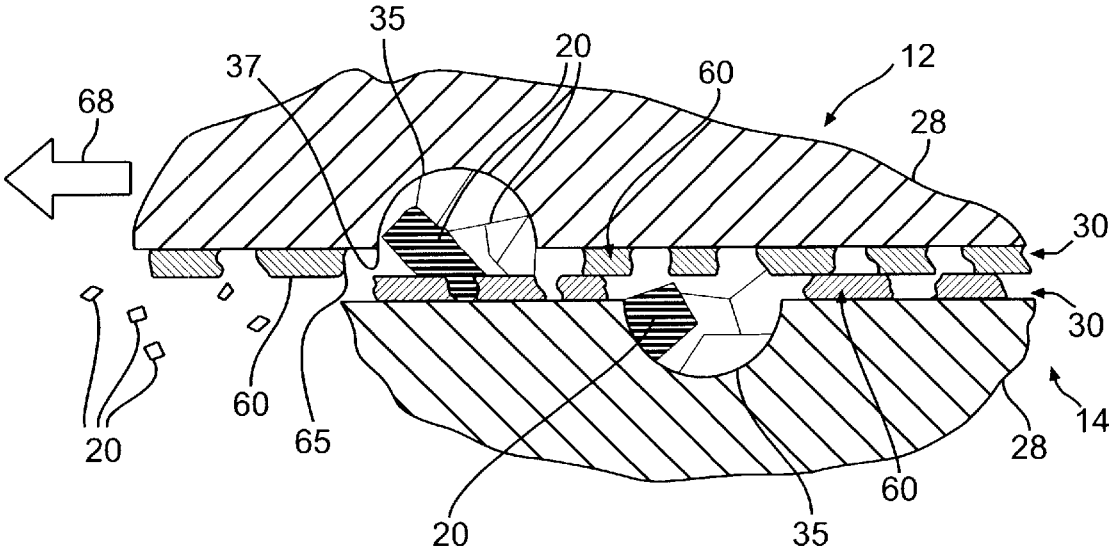

Cutting edges 65 defined by bumps 60 on the upper refining disk 12 cooperate with cutting edges 65 defined by bumps 60 on the lower refining disk 14 to cut material 20 as upper refining disk 12 rotates relative to lower refining disk 14, as shown in FIGS. 6–8. In addition, as shown in FIGS. 6–8, cutting edges 37 of grooves 35 cut material 20 as upper refining disk 12 rotates relative to lower refining disk 14. As material 20 passes through grooves 35, the larger pieces of material 20 are cut by cutting edges 37 of grooves 35. These cut pieces of material 20 are then further reduced in size by having cutting edges 65 of bumps 60 further cut material 20.

In operation, material 20 flowing through inlet tube 16 enters openings 34 of upper and lower refining disks 12, 14. Material 20 then flows outwardly between refining disks 12, 14 so that material 20 exiting from the outer edges 46 of each refining disk 12, 14 is smaller than material 20 being fed through inlet tube 16, as shown in FIGS. 3 and 4. Grooves 35 of base portion 28 and bumps 60 of refining portion 30 cooperate to reduce the size of material 20 as material 20 flows between refining disks 12, 14 outwardly across refining portion 30.

Grooves 35 enable material 20 to be injected into the refining portion 30 of refining disks 12, 14, as shown in FIGS. 6–8. As shown in FIG. 6, larger pieces of material 20 can flow between refining disks 12, 14 when grooves 35 of each refining disk 12, 14 are aligned with one another. Then, as shown in FIG. 7, the larger pieces of material 20 that are trapped within grooves 35 are cut by cutting edges 37 of grooves 35 as groove 35 on upper refining disk 12 rotates away from groove 35 on lower refining disk 14. As shown in FIG. 8, grooves 35 break down (or cut) the larger pieces of material 20 so that smaller pieces of material 20 can then be processed by bumps 60 of refining portion 30. As shown in FIGS. 5 and 8, bumps 60 cooperate with one another to further cut material 20 so that material 20 exiting from outer edge 46 of upper and lower refining disks 12, 14 is sufficiently small. For example, material 20 is preferably a slurry rubber material having rubber pieces that are approximately 2 mm (or 10 mesh) entering the system and which are cut by grooves 35 and bumps 60 so that material 20 exiting the system is approximately 0.25 mm (or 60 mesh).

Grooves 35 and bumps 60 cooperate to cut material 20 as material 20 passes between refining disks 12, 14. Refining disks 12, 14 are held together under significant pressure. For example, when rubber material is being processed, the pressure between refining disks 12, 14 is approximately 3000 psi. Bumps 60 are made of a hardened substance such as tungsten metal carbide to permit refining disks 12, 14 to be held under such pressure without prematurely wearing out the refining portion 30.

Figure 9:
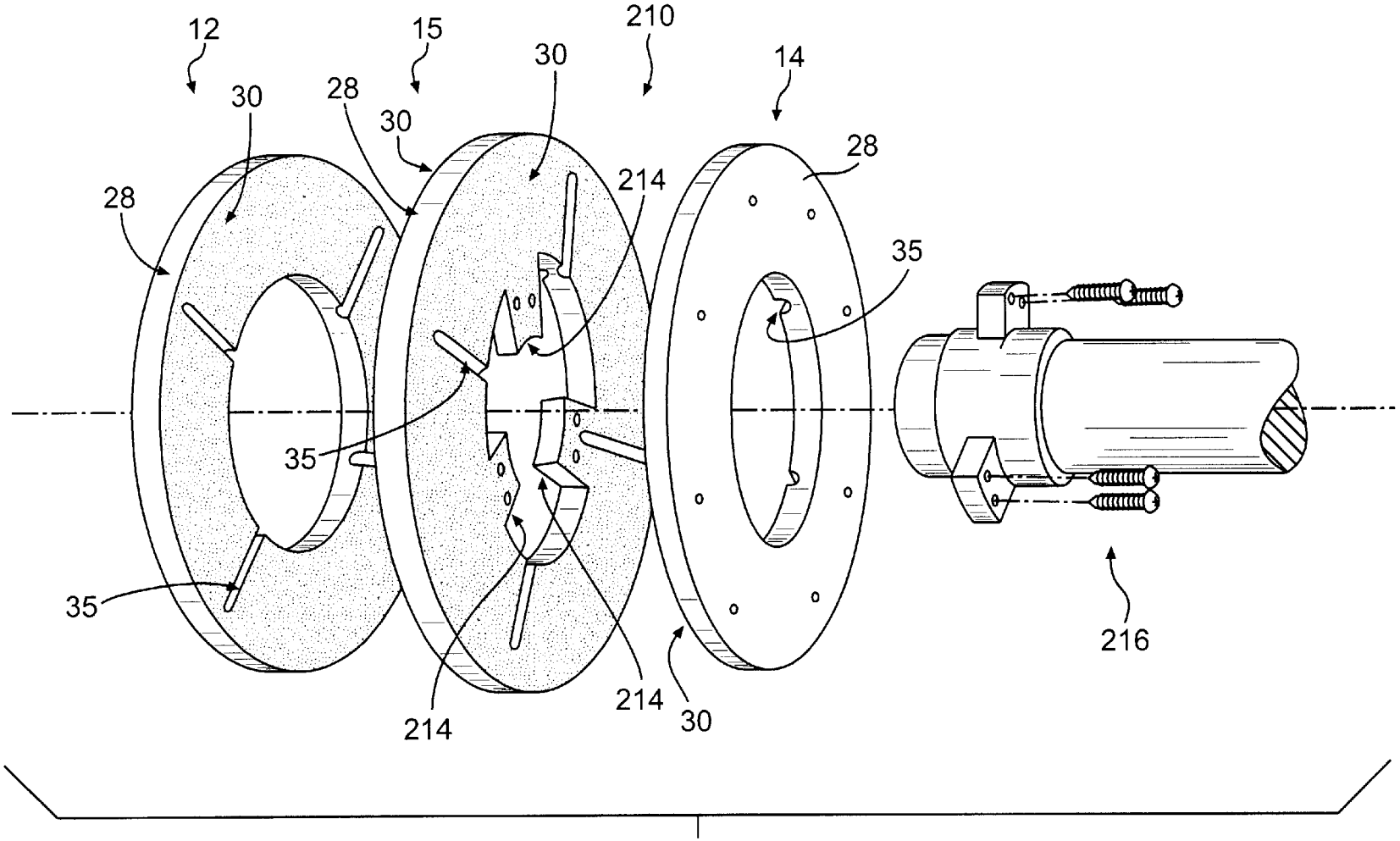
FIG. 9 illustrates a horizontal double-disk refining system where a single rotating disk is positioned between two stationary disks, showing the single disk having two particulate metal carbide refining portions coupled on opposite sides of the base portion and the two stationary disks having only one refining portion which engages the respective refining portion of the rotating disk.

As shown in FIG. 9 refining disks 12, 14 may be combined with a third refining disk 15 for use in a horizontal double-disk refining system 210. In the horizontal double-disk refining system 210, third refining disk 15 is positioned horizontally between refining disks 12, 14. Third refining disk 15 is identical to refining disks 12, 14 except that third refining disk 15 has two refining portions 30 coupled to opposite sides of base portion 28 and third refining disk 15 also has three inwardly-projected mount portions 214 that permit third refining disk 15 to be mounted to a drive rod 216.

Horizontal double-disk refining system 210 includes a housing (not shown) that extends around refining disks 12, 14, 15 and drive rod 216. Refining disks 12, 14 are rigidly mounted to the housing so that refining disks 12, 14 are stationary and material 20 flows through the central openings 34 of refining disks 12, 14, as shown illustratively in FIG. 9. Drive rod 216 extends through one of refining disks 12, 14 and is coupled to mount portions 214 of third refining disk 15. Drive rod 216 is used to rotate third refining disk 15 relative to refining disks 12, 14. As third refining disk 15 rotates relative to refining disks 12, 14, material 20 is forced under centrifugal force to flow through grooves 35 and across refining portion 30 of refining disks 12, 14, 15 so that material 20 is reduced in size in a similar fashion as discussed above with regard to the single-disk refining system 10. Thus, FIG. 9 is intended to show that a refining disk of the present invention may be used in a variety of refining systems including but not limited to horizontal and vertical refining systems, and single-disk and double-disk refining systems.

The purpose of this example was to determine the feasibility of grinding elastomers with a refining disk comprised of stainless steel and a grinding surface of tungsten.

The stainless steel tungsten coated plate was mounted on the bottom of the grinder and a vitrified grinding stone as commonly used in the art was placed on the top to oppose the steel plate. The grinder was placed into rotation and clean water was allowed to flow into. the grinder. The tungsten coated steel plate and grinding stone were then brought together until the water flow was impeded and the water temperature was elevated between the inlet and exit of the grinder.

For this example, tire rubber pre-ground to about an 8 mesh was feed into the grinder. The rubber traveled between the two plates and was reduced in size. For this example, the exact rate of conversion was unclear but was estimated at about 50%.

This example demonstrated that a refining disk such as a tungsten coated stainless steel plate could be used to grind an elastomer by rotating the refining disk against another surface. The other surface in this case was a grinding stone but could be any type of material that provides a surface such that the refining disk can turn relative to it (i.e., at least the refining disk is capable of turning or alternatively, both the refining disk and the second surface can turn simultaneously and/or in tandem).

Although the invention has been described in detail with reference to certain illustrated embodiments, variations and modifications exist within the scope and spirit of the invention as described and defined in the following claims.

What is claimed is:

1. A refining disk for refining a material, the refining disk comprising a base portion made of a first substance and a refining portion coupled to the base portion and adapted to engage the material to refine the material, the refining portion being made of a second substance that is harder than the first substance, wherein the base portion is defined by an inner surface and an outer surface, and wherein grooves are formed in the base portion starting from the inner surface and extending toward the outer surface, and wherein the refining portion are defined by a plurality of particulate bumps on a surface of said refining portion.

2. The refining disk of claim 1, wherein the first substance is stainless steel.

3. The refining disk of claim 2, wherein the second substance is tungsten.

4. The refining disk of claim 2, wherein the refining portion is welded to the base portion.

5. The refining disk of claim 1, wherein the second substance is a particulate metal carbide substance.

6. The refining disk of claim 5, wherein the second substance is tungsten.

7. The refining disk of claim 5, wherein the second substance is silicon.

8. The refining disk of claim 1, wherein the particulate bumps comprise tungsten.

9. A method for refining a material comprising the steps of: introducing a material between a first refining disk and a second refining disk, each refining disk having a base portion and a refining portion coupled to the base portion, the refining portions being made of a substance that is harder than the base portion and the refining portions being defined by a plurality of particulate bumps on a surface of said refining portions such that the bumps of the first refining disk abut the bumps of the second refining disk, wherein the base portions are defined by an inner surface and an outer surface, and wherein grooves are formed in the base portions starting from the inner surface and extending toward the outer surface, and rotating the first refining disk relative to the second refining disk so that the material is cut by the bumps as the material passes between the refining portions.

10. A method for refining a material comprising:

introducing a material between a first refining disk and a surface to refine said material, wherein said refining portion of said disk being made of a substance that is harder than a base portion of said disk, and the refining portion being defined by a plurality of bumps such that the bumps of the refining disk abut said surface, and wherein the base portion is defined by an inner surface and an outer surface, and wherein grooves are formed in the base portion starting from the inner surface and extending toward the outer surface.

11. The method of claim 9, wherein the material is rubber.

12. The method of claim 10, wherein the material is rubber.

13. A refining disk for refining material, the refining disk comprising a base portion made of a first substance and a refining portion coupled to the base portion and adapted to engage the material to refine the material, wherein the refining portion being made of a second substance that is harder than the first substance, wherein the refining portion is welded to the base portion, wherein the base portion is defined by an inner surface and an outer surface, and wherein grooves are formed in the base portion starting from the inner surface and extending toward the outer surface and wherein the refining portion are defined by a plurality of particulate bumps on a surface of said refining portion.

14. A refining disk for refining a material, the refining disk comprising a base portion made of a first substance and a refining portion coupled to the base portion and adapted to engage the material to refine the material, the refining portion being made of a second substance that is harder than the first substance and the refining portion being defined by a plurality of bumps, wherein the base portion is defined by an inner surface and an outer surface, and wherein grooves are formed in the base portion starting from the inner surface and extending toward the outer surface.

* * * * *